US007591054B2

(12) United States Patent
Baughman

(10) Patent No.: US 7,591,054 B2
(45) Date of Patent: Sep. 22, 2009

(54) INSERTION DIE TOOLING FOR FLANGE INSTALLATION AND THE METHOD OF USE

(75) Inventor: Gary M. Baughman, Fremont, IN (US)

(73) Assignee: Rieke Corporation, Auburn, IN (US)

( * ) Notice: Subject to any disclaimer, the term of this patent is extended or adjusted under 35 U.S.C. 154(b) by 400 days.

(21) Appl. No.: 11/590,496

(22) Filed: Oct. 31, 2006

(65) Prior Publication Data

US 2008/0120830 A1 May 29, 2008

(51) Int. Cl.
*B23P 19/00* (2006.01)

(52) U.S. Cl. ..... 29/243.5; 29/281.1; 29/505; 72/490

(58) Field of Classification Search ..... 29/243.5, 29/505, 509, 283.5, 281.1, 700; 72/490, 72/470

See application file for complete search history.

(56) References Cited

U.S. PATENT DOCUMENTS

| | | | | |
|---|---|---|---|---|
| 3,747,962 | A | 7/1973 | Bauman | 285/202 |
| 3,791,021 | A | 2/1974 | Bauman | 29/510 |
| 3,969,809 | A * | 7/1976 | Pouch et al. | 29/243.5 |
| 4,130,932 | A * | 12/1978 | Epmeier | 29/523 |
| 4,189,824 | A * | 2/1980 | Dillon et al. | 29/522.1 |
| 4,588,103 | A | 5/1986 | Baughman | 220/288 |
| 4,910,853 | A * | 3/1990 | Sawdon | 29/283.5 |
| 5,339,509 | A * | 8/1994 | Sawdon et al. | 29/432 |
| 5,943,757 | A | 8/1999 | Magley | 29/509 |
| 6,360,415 | B1 * | 3/2002 | Wada et al. | 29/283.5 |
| 6,418,608 | B2 | 7/2002 | Keesler | 29/430 |
| 7,322,086 | B2 * | 1/2008 | Humpert et al. | 29/243.5 |
| 2005/0269330 | A1 | 12/2005 | Baughman | 220/228 |
| 2008/0120830 | A1 * | 5/2008 | Baughman | 29/700 |

FOREIGN PATENT DOCUMENTS

| | | |
|---|---|---|
| DE | 103 48 851 | 7/2005 |
| DE | 103 48 851 A1 | 7/2005 |
| GB | 421 167 A | 12/1934 |

OTHER PUBLICATIONS

European Search Report dated Jan. 16, 2008 issued in European Patent Application No. 07253663.4.

* cited by examiner

*Primary Examiner*—Lee D Wilson
(74) *Attorney, Agent, or Firm*—Woodard, Emhardt, Moriarty, McNett & Henry LLP

(57) ABSTRACT

Insertion die tooling for the installation of a flange into a drum end embossment according to one embodiment of the present invention comprises a stationary work station constructed and arranged to receive an internally-threaded metal flange and a portion of a metal drum end, the metal drum end being formed with an embossment to be positioned over the metal flange and a movable pressure unit including a closing collet constructed and arranged with a plurality of collet segments, a punch holder attached to a closing ring, and a pilot that is constructed and arranged to be movable with movement of the punch holder, the pilot including a frustoconical portion constructed and arranged for engagement with the embossment for forming a tapered inner drum end wall adjacent an inner surface of the flange.

10 Claims, 3 Drawing Sheets

INSERTION DIE TOOLING FOR FLANGE INSTALLATION AND THE METHOD OF USE

BACKGROUND OF THE INVENTION

The present invention relates in general to metal drum fabrication and the insertion die tooling associated with this fabrication. The present invention more specifically relates to the configuring of the drum end with an installed, internally-threaded flange and the associated insertion die tooling. The referenced flange is constructed and arranged for receipt of an externally-threaded closing plug. The present invention relates to the construction and arrangement of the insertion die tooling and modifications to that tooling that relate directly to the installation of the flange into an embossment formed in the metal of the drum end.

Prior to loading the drum end onto a corresponding work station of the insertion die tooling, the metal drum end is formed with the embossment which provides a shaped annular pocket that is constructed and arranged to receive the flange. Thereafter, in terms of the fabrication sequence, the metal of the drum end is formed over, under, and around the flange so as to securely anchor the flange into the drum end. This basic construction method and configuration is well known in the industry and represents technology that has been practiced for several years. Traditionally, the initial forming of the drum end pocket or embossment included an outer annular wall that had a generally cylindrical shape and an upper, substantially planar panel that was substantially perpendicular to the outer annular wall. In this final configuration, the drum end material does not extend into the open interior defined by the flange outer wall.

This flange and drum end construction and structural relationship is described generally in U.S. Pat. No. 5,943,757, in the context of a new one-step insertion die. The '757 patent issued Aug. 31, 1999 to Magley and is incorporated by reference herein in its entirety. One difference between the '757 patent and prior art fabrication methods and tooling is the forming of the embossment as one step in the overall sequence as contrasted to having that embossment preformed in the drum end prior to loading the drum end onto the lower work station. Importantly, in the context of the present invention, neither the '757 patent nor the prior art installation constructions for metal flanges disclose any inner axial wall being formed as part of the drum end. The reference to "inner" refers to an axial wall being formed on the inside of the flange. While the basics of the crimping procedure so as to install a flange into the drum end pocket or embossment are believed to be well known, this fabrication is performed without the use of any inner axial wall for these types of metal flanges.

In U.S. Pat. No. 4,588,103, a plastic closure (20), shaped as an internally-threaded flange, is installed into boss (41) that is formed in the metal drum end (42) as illustrated in FIG. 2 of the '103 patent. The insertion tooling illustrated in FIG. 5 of the '103 patent includes a center holding and forming die (53) which is of annular shape and contoured along its lower surface so as to fit snugly up against upper wall (45) after forming inner wall (44) of boss (41). Inner wall (44) and outer wall (43) are substantially concentric with one another. Center annular portion (55) helps to form inner wall (44) and is positioned against inner wall (44) as the crimping members or collets (54) act on boss (41). Importantly, the center annular portion (55) is cylindrical.

In U.S. patent application Ser. No. 10/971,874, filed Oct. 22, 2004 and published Dec. 8, 2005 as Publication Number US-2005-0269330-A1, an inner annular wall is formed in a metal drum end as a part of the overall insertion construction for a metal, internally-threaded flange. The forming of the drum end includes shaping an outer annular wall that is generally cylindrical, an upper, generally planar panel, and the inner wall. As illustrated in FIG. 10 of the '874 application, the inner wall (27) is inwardly and downwardly tapered into a frustoconical form. The insertion of the metal flange into the drum end and its final installation involves the application of opposing inner and outer forces directed against portions of the drum end material.

The present disclosure is directed to an improvement in the insertion die tooling by changing the cylindrical form of the center annular portion or pilot into a frustoconical form. As one example of a pilot, refer to portion (55) in the '103 patent. This same modification, according to the present disclosure, would be applicable to any prior art insertion die tooling where a cylindrical center form or pilot is used for the shaping of a generally cylindrical inner wall. This particular change in the insertion die tooling results in an improved structure as compared to an inner tooling form that is cylindrical. One benefit derived from the present disclosure is the ability to change the thickness of the drum end material without having to change the insertion die tooling for proper installation of the flange.

BRIEF SUMMARY

Insertion die tooling for the installation of a flange into a drum end embossment according to one embodiment of the present invention comprises a work station constructed and arranged to receive an internally-threaded metal flange and a portion of a metal drum end, the metal drum end being formed with an embossment to be positioned over the metal flange and a movable pressure unit including a closing collet, a punch holder attached to a closing ring, and a pilot that is constructed and arranged to be movable with movement of the punch holder, the pilot including a frustoconical portion constructed and arranged for engagement with the embossment for forming an inner drum end wall adjacent an inner surface of the flange.

One object of the present disclosure is to describe improved insertion die tooling for the installation of a flange into a drum end embossment.

DETAILED DESCRIPTION

Figure 1:
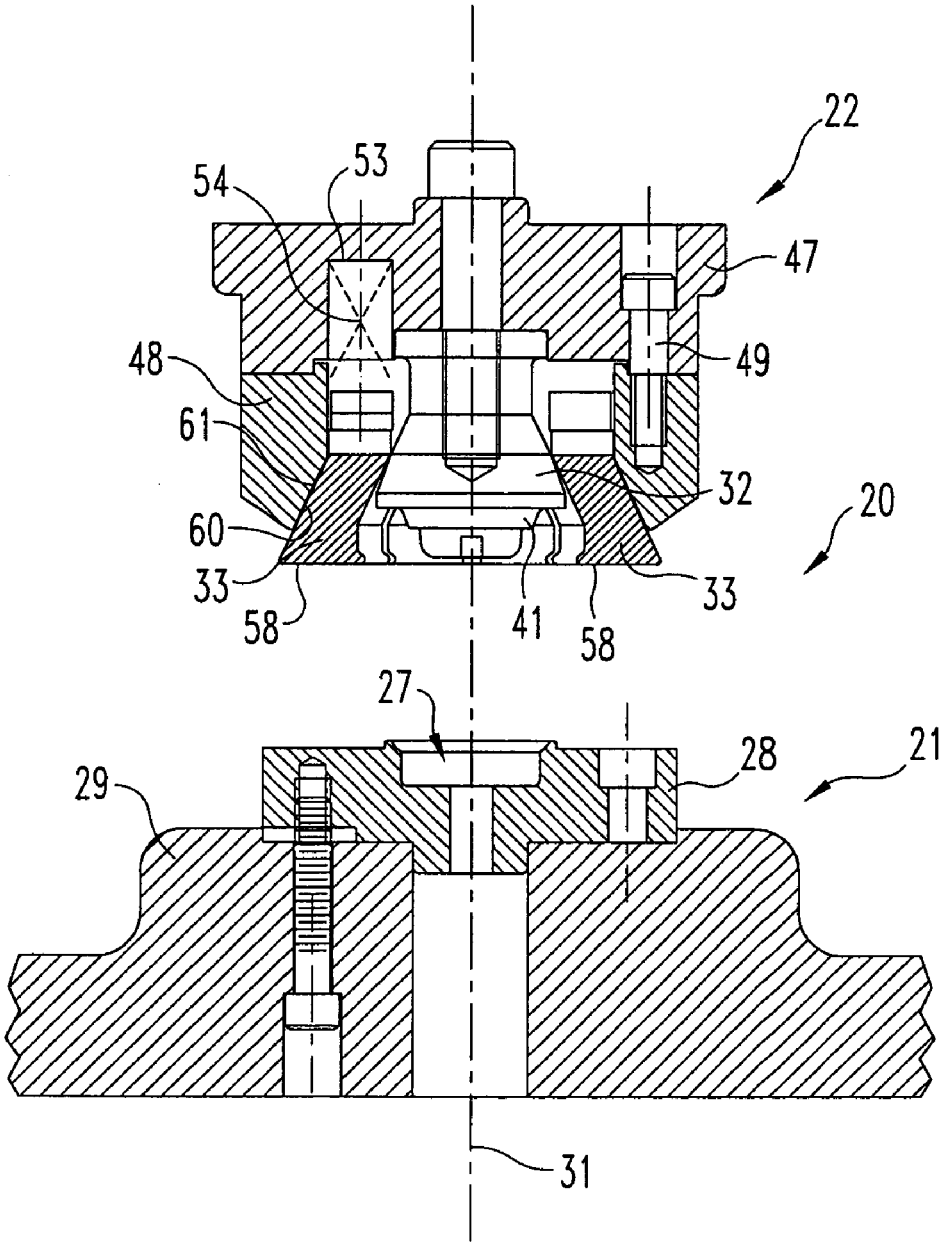
FIG. 1 is a front elevational view, in full section, of insertion die tooling in an open position according to a typical embodiment of the present invention.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

Figure 2:
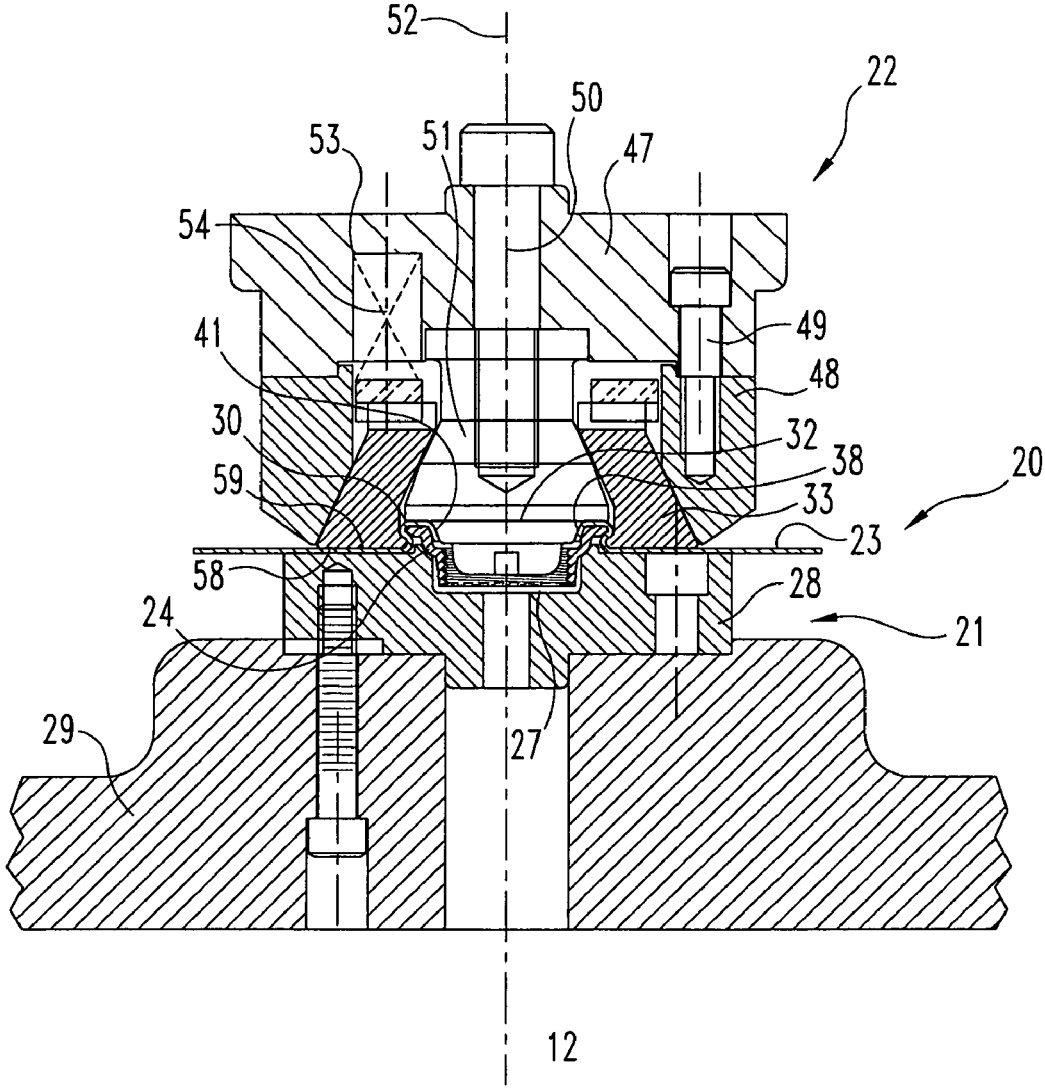
FIG. 2 is a front elevational view, in full section, of the FIG. 1 insertion die tooling in a closed position with a flange and drum end inserted.

Referring to FIGS. 1 and 2, there is illustrated insertion die tooling 20 according to the present disclosure. The present disclosure describes a preferred embodiment of the invention. Tooling 20 includes a stationary, lower work station 21 and an axially movable upper pressure unit 22. The lower work station 21 is constructed and arranged for receipt of the flange 24 and a portion of the drum end 23. The preferred embodiment is illustrated for a three-quarter inch (¾") flange 24 which represents the typical type of flange for the venting location of the drum. It is expected that a second work station will be included for installation of a two inch (2") flange that is used for a dispensing closure. As illustrated and described in U.S. Pat. No. 5,943,757, providing two work stations, one for the two inch flange and one for the three-quarter inch flange, enables use of the same type of pressure unit, a portion of which is shown as unit 22, and the same (simultaneous) sequence of installation steps. For the purposes of this disclosure, the insertion die tooling 20 for a two inch flange 24 is selected and illustrated. The same basic structure and steps would apply for the three-quarter inch flange, simply scaled dimensionally for proper sizing. It is also to be understood that combining the two work stations provides added efficiency since the entire drum end 23, in one step, is able to be loaded onto both work stations, concurrently, and both flanges installed with substantially the same process steps and sequence.

Figure 3:
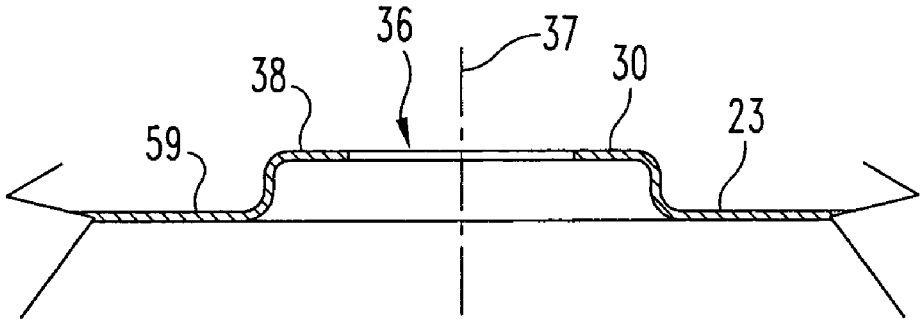
FIG. 3 is a front elevational view, in full section, of a drum end embossment formed prior to placing the drum end in the insertion die tooling.

FIG. 1 illustrates insertion die tooling 20 in what is described as an "open" position prior to the loading of the flange 24 and prior to placement of the drum end 23 over the flange within the tooling 20. FIG. 2 illustrates insertion die tooling 20 in what is described as a "closed" position after all of the forming and installing steps have been performed. In progressing from the FIG. 1 position to the FIG. 2 position, the selected flange 24 is placed into receiving pocket 27 that is defined by fixture 28. Fixture 28 in turn is assembled into position on base 29 that forms part of the lower work station 21. When the drum end 23 is formed for receipt of flange 24 by a one-step insertion die, as that disclosed in U.S. Pat. No. 5,943,757, the drum end 23 arrives at work station 21 with a substantially flat or planar interior portion that will be formed to receive the two inch and three-quarter inch flanges. When the drum end is not formed by a one-step insertion die, the drum end 23 is pre-formed with a flange-receiving embossment 30, as illustrated in FIG. 3.

The flange 24, as positioned in pocket 27, is centered on axial centerline 31 that extends through the axial (geometric) center of pocket 27 and through the axial center of the pilot 32 that is assembled into the pressure unit 22 and is surrounded by closing collet 33. The closing collet 33 actually consists of a series of individual collet sections or segments, referred to herein as closing collets 33. The flange 24 includes an upper surface 34 and an inner (un-threaded) annular wall 35 (see FIG. 4). The inside diameter of wall 35 is larger than the inside diameter of the opening 36 of the embossment 30. Opening 36 is substantially circular with an axial centerline 37 that is substantially coincident with centerline 31. In this way, the radial lip 38 of embossment 30 extends inwardly toward centerline 37 beyond the inner, annular surface 35*a* of annular wall 35. In the prior art designs for the metal flange and drum end combination, the radial lip 38 of the embossment 30 did not extend (in the final assembly) beyond the inside surface of the annular wall of the metal flange. This is shown in U.S. Pat. No. 5,943,757 in FIG. 5A.

Assuming that the outside diameter of the two inch metal flange remains substantially the same and assuming that the flange inside diameter, at its upper surface, stays substantially the same, then by reducing the size of the opening 36 of embossment 30, there is sufficient material to form over into an inner annular wall that extends downwardly into the interior of the flange away from the flange upper surface. This inner drum end wall is illustrated in U.S. patent application Ser. No. 10/971,874. An inner drum end wall, for a plastic closure flange, is disclosed in U.S. Pat. No. 4,588,103.

In U.S. Pat. No. 4,588,103, the center annular portion (55) that moves axially into the opening defined by the inner wall (44) of the drum end (42) is cylindrical. In a similar manner, the inserting portion or pilot for the angled inner wall of U.S. patent application Ser. No. 10/971,874 can be cylindrical. The diameter of this axially-moving pilot in turn helps to determine if there is any angle of incline of the inner drum end wall and if there is, the details of its frustoconical shape, including the final dimensions. Since the angled or inclined inner wall influences gasket compression and release, the angle of incline and the inside diameter sizes of the inner wall along its axial length are important.

The insertion die tooling 20 provides a novel and unobvious change to the prior cylindrical form of the pilot that was used for a plastic closure flange. Insertion die tooling 20 includes a pilot 32 that is constructed and arranged with a frustoconical surface 41 that is adjacent to and pushes against the radial lip 38 of drum end material in the process of creating the frustoconical inner drum end wall 42. The pilot is surrounded by a series of six closing collets 33 that pivot inwardly to push the drum end material beneath the flange lip 43 and against the outer edge 44 of the flange lip 43. While the closing collets 33 are pivoting inwardly, the pilot 32 is moving in a downward axial direction so as to push downwardly and outwardly on the frustoconical inner drum end wall 42. These opposing inner and outer forces tightly secure the metal of the drum end 23 in, over, under, and around the flange 24, specifically the flange lip 43 and wall 35. As was noted in U.S. patent application Ser. No. 10/971,874, these opposing forces that act against each other also provide a type of back-up support for each other, enabling much higher compression forces to be applied, as compared to the prior art structures for a metal flange that do not include an inner annular wall. As such, any serrations that might be included about the outer surface of the flange lip are not required for a tight and securely installed flange 24 into the drum end 23 embossment 30.

With continued reference to FIGS. 1 and 2, the pressure unit 22 further includes a punch holder 47 that is assembled to a closing ring 48 by three, equally-spaced socket head cap screws 49. A socket head cap screw 50 extends through the punch holder 47 and threads into the upper portion 51 of pilot 32, generally concentric with axial centerline 52. Cylindrical pockets 53 are machined into the punch holder 47 and receive springs 54 that assist in the movement of the closing collets 33. The closing collets 33 float within the hollow interior of the closing ring 48 and are captured by their shape and by the shapes of the surrounding parts, including the closing ring 48, punch holder 47, and pilot 32. As would be understood from U.S. Pat. No. 5,943,757, downward movement of pressure unit 22 initially places the lower surface 58 of each collet 33 directly against the upper surface 59 of the drum end 23 just immediately to the outside of the outer edge 44 of flange lip 43. Based upon the FIG. 1 illustration, the pilot 32 has not yet moved fully into the flange.

The next step in the process is for the punch holder 47 and closing ring 48 combination (i.e., assembled together with cap screws) to move axially toward the drum end 23 and flange 24. As this movement occurs, the angled face 60 of the closing ring pushes inwardly on the contacted face 61 of each collet. This causes each collet 33 to pivot its lower edge inwardly, drawing drum end material inwardly below the flange lip 43. The axial movement of punch holder 47 means the same axial movement for pilot 32. The pilot 32 first contacts the inner edge of the radial lip 38 of the drum end that defines upper opening 36. With continued axial travel of pilot 32, the inner wall 42 is formed as the pilot pushes downwardly and outwardly against inner wall 42. This outwardly directed force is applied concurrently with the inwardly directed force from the collets 33. As described, these opposing forces and the back-up reinforcement or support provided by the pilot 32 enables significantly higher compressive forces to be applied to the drum end material that extends around the inside and outside of flange 24.

The corresponding tooling 20 is novel and unobvious in terms of its structure and use. Creating a frustoconical form 41 for that portion of the pilot 32 that forms the inner wall 42 is an improvement. Further, the ability to use that frustoconical form as a back-up reinforcement and as a way to generate an outwardly directed force is an improvement.

A further benefit has been identified as a result of the frustoconical form for that portion of the pilot 32, as contrasted to a pilot construction that employs a cylindrical form. When the flange design and its installation into a drum end embossment would permit a thinner drum end material to be used, that would result in a cost savings. One reason that a thinner material would be acceptable is due to the higher compressive forces that can be used. The question then is whether the insertion die tooling can remain the same as the material thickness changes and becomes thinner or changes back to a thicker form. A critical factor in this analysis is the addition of the inner drum end wall 42.

Figure 4:
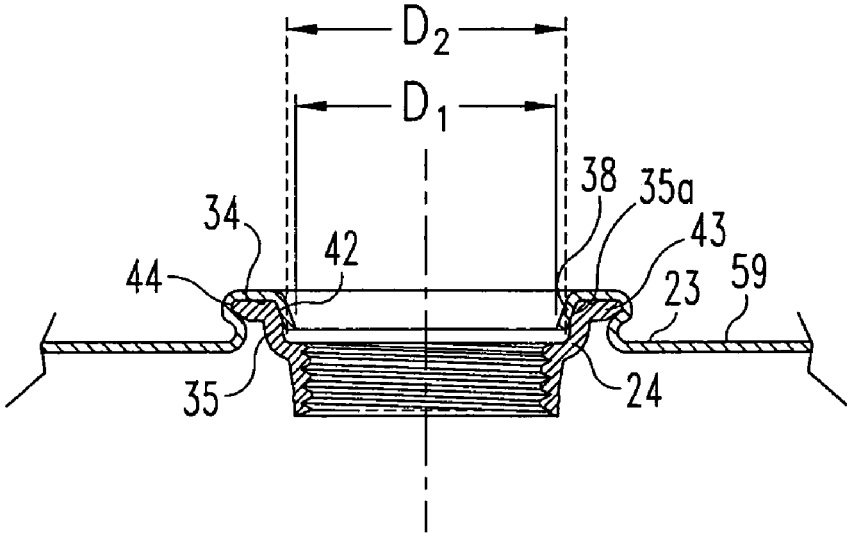
FIG. 4 is a front elevational view, in full section, showing the final installation of the flange into the embossment as shaped by the FIG. 1 insertion die tooling.

When an inner annular drum end wall is included as part of the flange installation construction, an inside diameter opening is created, shown as $D_1$ in FIG. 4. When a generally cylindrical pilot is used, typical of the known prior art, its outside diameter is fixed and is the same throughout is axial extent or length. This outside diameter helps to define the magnitude of the outwardly directed forces and the degree of interference with the inner wall 42. When the drum end material is made thinner, then in order to form and compress the inner wall 42 in the desired manner, the cylindrical size of the pilot needs to be increased to match the $D_2$ dimension (see FIG. 4). Varying or changing the axial depth of insertion of the cylindrical pilot into the flange does not affect the condition created by the size difference. If the pilot size is not changed for the thinner drum end material, then the inner wall 42 will not be fully formed in the desired manner. By changing the insertion die tooling 20 to include a frustoconical portion 41 as part of the pilot 32, changes in the drum end material thickness can be accommodated without the need to change or redesign the tooling. Since the diameter size of portion 41 increases as the frustoconical taper diverges in a direction away from the flange, all that would need to be done is to insert the pilot farther into the flange so as to achieve the intended design form to inner wall 42 and to exert the desired outwardly directed force.

In terms of the axial travel of pilot 32 and accordingly of frustoconical surface 41, an interesting effect occurs. With a thinner drum end material, the upper surface of the radial lip 38 material that extends over flange lip 43 is lower, i.e., closer to the flange lip 43. This in turn means that before the lower surface of the collets 33 contact the upper surface of the radial lip, the pressure unit must axially travel a little farther, this added distance corresponding to the reduction in thickness. This then means that that the starting position of the pilot 32 and surface 41 is a little farther in the direction of the flange. The axial travel of the punch holder 47 and closing ring 48 combination can remain substantially the same, but the pilot actually goes deeper into the flange for an increased amount of travel that generally corresponds to the change in the material thickness of the drum end. While there is not a 1:1 correlation due to the frustoconical angle of taper, it is very close considering the magnitude of the dimensional changes to the drum end material thickness.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. Insertion die tooling for the installation of a flange into a drum end embossment, said insertion die tooling comprising:

a stationary work station constructed and arranged to receive an internally-threaded metal flange and a portion of a metal drum end, said metal drum end being formed with an embossment to be positioned over said metal flange; and an axially movable pressure unit including a closing collet constructed and arranged with a plurality of collet segments, a punch holder attached to a closing ring and a pilot that is constructed and arranged to be movable with movement of said punch holder, said pilot including a frustoconical surface constructed and arranged for contacting said embossment for forming an inner drum end wall adjacent an inner surface of said flange.

2. The insertion die tooling of claim 1 wherein said pilot includes an axial centerline and said stationary work station is constructed and arranged for centering said flange on said axial centerline.

3. The insertion die tooling of claim 1 wherein said movable pressure unit further includes a plurality of springs that are constructed and arranged to assist in movement of said plurality of collet segments.

4. Insertion die tooling for the installation of a flange into a drum end embossment, said insertion die tooling comprising:

a stationary work station constructed and arranged to receive an internally-threaded metal flange and a portion of a metal drum end, said metal drum end being formed with an embossment to be positioned over said metal flange; and an axially movable pressure unit including a closing collet member, a punch holder attached to a closing ring and a pilot that is constructed and arranged to be movable with movement of said punch holder, said pilot including a frustoconical surface constructed and arranged for contacting said embossment with said embossment for forming an inner drum end wall adjacent an inner surface of said flange.

5. The insertion die tooling of claim 4 wherein said pilot includes an axial centerline and said stationary work station is constructed and arranged for centering said flange on said axial centerline.

6. The insertion die tooling of claim 4 wherein said movable pressure unit further includes a plurality of springs that are constructed and arranged to assist in movement of said collet member.

7. Insertion die tooling for the installation of a flange into a drum end embossment, said insertion die tooling comprising:

a work station constructed and arranged to receive an internally-threaded metal flange and a portion of a metal drum end, said metal drum end being formed with an embossment to be positioned over said metal flange; and an axially movable pressure unit including a closing collet member, a punch holder attached to a closing ring and a pilot that is constructed and arranged to be movable with movement of said punch holder, said pilot including frustoconical surface constructed and arranged for contacting said embossment for forming an inner drum end wall adjacent an inner surface of said flange.

8. The insertion die tooling of claim 7 wherein said pilot includes an axial centerline and said work station being constructed and arranged for centering said flange on said axial centerline.

9. The insertion die tooling of claim 7 wherein said pressure unit further includes a plurality of springs that are constructed and arranged to assist in movement of said plurality of collet member.

10. The insertion die tooling of claim 9 wherein said collet member includes a plurality of collet segments.

* * * * *